United States Patent [19]

Harvey

[11] Patent Number: 4,509,213

[45] Date of Patent: Apr. 9, 1985

[54] RAIN COVER FOR MOTORCYCLIST'S LEGS

[76] Inventor: Marc Harvey, 18, St-Cyrille, Outremont, Quebec, Canada, H2V 1H8

[21] Appl. No.: 389,945

[22] Filed: Jun. 18, 1982

[30] Foreign Application Priority Data

Aug. 19, 1981 [CA] Canada ..... 384179

[51] Int. Cl.[3] ..... A41D 13/02

[52] U.S. Cl. ..... 2/22; 2/227; 2/231

[58] Field of Search ..... 2/22, 2.1 R, 2.1 A, 2/2, 82, 227, 231, 46, 87, 86

[56] References Cited

U.S. PATENT DOCUMENTS 1,369,538 2/1921 Paxton ..... 2/227

3,111,680 10/1962 Horowitz et al. ..... 2/227

FOREIGN PATENT DOCUMENTS 1126925 11/1954 France .

861509 11/1959 France ..... 2/86

*Primary Examiner*—Werner H. Schroeder

*Assistant Examiner*—Mary A. Ellis

*Attorney, Agent, or Firm*—Robic, Robic & Associates

[57] ABSTRACT

A pair of identical leggings in one piece are disclosed and are adapted to cover and protect from rain the lower body of a motorcyclist from the waist down, including his feet, leaving only the shoe soles exposed. Elastic-retaining means are provided all along the perimeter of the gaiter portion of the leggings, while the leggings themselves are provided with accordeon pleats in the region of the knees to permit easy flexing of the legs, while preventing disengagement of the gaiter portions.

5 Claims, 6 Drawing Figures

RAIN COVER FOR MOTORCYCLIST'S LEGS

FIELD OF THE INVENTION

The present invention relates to articles of clothing, more particularly to a new type of rain gear to protect the lower body and legs of a motorcyclist from getting wet.

BACKGROUND OF THE INVENTION

To ride in the rain, motorcyclists normally resort to water-proof pants worn over rubber boots. Such clothing is nonpractical and cumbersome, because it must be readily accessible in case of rain and, when not used, must therefore be stored on the motorcycle and takes quite a bit of room. The rubber boots are the most cumbersome pieces of equipment. However, rubber boots are conceived for submersion of the feet in water, whereas motorcyclists do not generally require this property, since they are only exposed to rain and to splashing from other vehicles. For such a purpose, gaiters would be sufficient.

OBJECTS OF THE INVENTION

Accordingly, it is the general object of the present invention to provide a pair of pants for motorcyclists which cover the user's body from the waist down, as well as the top portions of the feet, but without covering the sole.

It is another object to provide a rain cover of the character described, which is of very light weight and which can be folded to take up a minimum of room, so as to be easily stored on a motorcycle to be readily accessible whenever its use is required.

Another object of the invention is to provide a one-piece rain garment of the character described, avoiding separate parts which could easily be lost.

SUMMARY OF THE INVENTION

The rain garment of the invention comprises a pair of pants, or leggings, including an integral gaiter or foot-covering portion, leaving only the sole exposed, retaining means all along the perimeter of the gaiter portion to secure the latter to the perimeter of the sole of each shoe and pouch means at the knee portion of each legging to allow free bending movement of the user's knees without disengagement of the gaiter portion from the user's shoes.

In accordance with a preferred embodiment, the pouch portions at the wearer's knees are in the form of accordeon pleats extending around the front and sides of the leggings.

BRIEF DESCRIPTION OF THE DRAWINGS

The above will be clearly understood by having reference to a preferred embodiment of the invention illustrated by way of the accompanying drawings, in which.

Like reference numerals indicate like elements throughout the description and drawings.

DETAILED DESCRIPTION OF THE INVENTION

Figure 6:
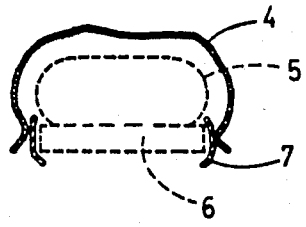

The invention comprises a rain garment made of nonextensible, water-proof material and adapted to cover the wearer's body from the waist down, including the entire legs L and the shoes, but excluding the sole of the wearer's shoes. The garment comprises a lower body-encircling portion 1, fitted at its top edge with an elastic waist band 2 and from which downwardly depend a pair of identical leggings 3 adapted to cover the entire user's legs L. The bottom portion of each legging 3 is extended by a gaiter portion 4, which is integral with the respective leggings 3. Each gaiter portion 4 is adapted to cover the upper and sides of the user's shoes, generally indicated at 5 in FIG. 6, and to extend only down to the perimeter of the sole 6, thereby leaving the underside of the sole exposed. Retaining means, preferably an elastic band 7, is stitched to the perimeter of the gaiter portion 4 and is adapted to extend all around the perimeter of the shoe sole 6.

Figure 2:
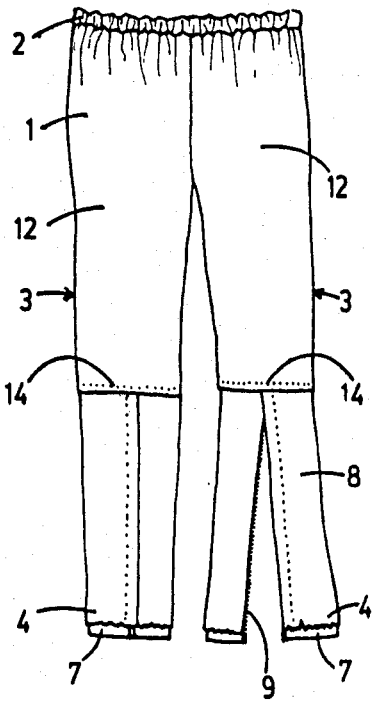
FIG. 2 is an elevation looking at the back of the rain garment.
Figure 4:
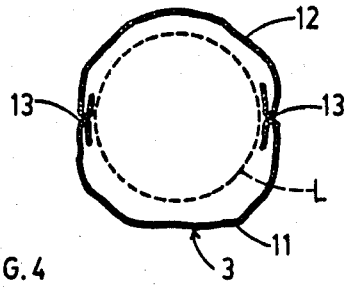
Figure 5:
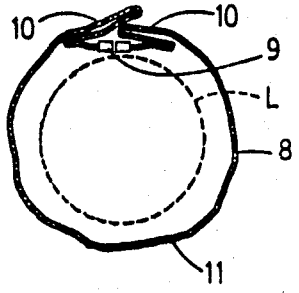

The back of the lower portion 8 of each legging 3 is longitudinally slit, as shown in FIG. 2, including the foot-covering portion 4 and the elastic band 7 up to the level of the back of the knee. This slit can be closed by a slide fastener 9. This enables slipping into the garment while allowing free passage of the user's shoes. The slide fastener enables the motorcyclist to close the garment with one hand and in one operation. As shown in FIG. 5, the slide fastener 9 is covered by a longitudinal fold 10 on each side of the slit adapted to overlap in the closed position of the slide fastener to protect it from rain and dirt.

The upper portion of each legging is made of a front panel 11 and a back panel 12, stitched together at the inside and outside lateral surfaces of each legging by longitudinal stitching lines 13. In accordance with a preferred embodiment, the back panel 12 is replaced in the lower portion of each legging under knee level by an enlargement of the front panel 11 attached to the lower part of the upper back panel 12 along a horizontal line of stitching, indicated at 14 in FIG. 2. The purpose of this type of assembly is to eliminate as many lines of stitching as possible in the lower front part of the garment which is the most exposed one.

Since the gaiter portions are an integral part of the leggings and are retained around the perimeter of the wearer's shoe sole, and since the material constituting the rain garment is non extensible, it is essential that the garment be provided with means to allow free flexing of the wearer's knees to prevent an upward pull on the gaiter portions and their displacement relative to the wearer's shoes. Accordingly, pouch means are provided in each legging in the region of the knee to eliminate any upward pull on the gaiter portions during knee flexing.

Figure 1:
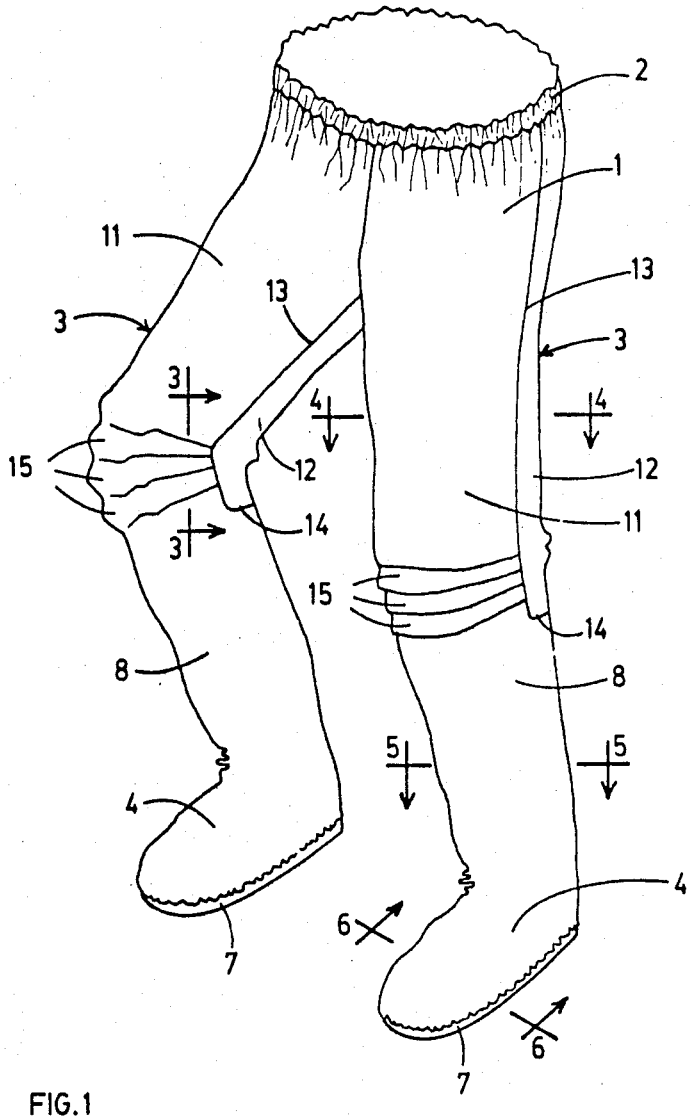
FIG. 1 is a perspective view of the rain garment in wearing configuration.
Figure 3:
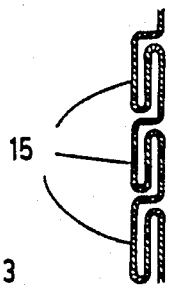
FIGS. 3, 4, 5, and 6 are cross-sections taken along lines 3—3, 4—4, 5—5, and 6—6, respectively, of FIG. 1.

In accordance with a preferred embodiment, these pouch means are formed by a plurality of accordeon pleats, indicated at 15 and transversely extending across the front portion of each legging in the region of the knee from one to the other of the longitudinal lateral lines of stitchings 13, these accordeon pleats 15 being shown in FIG. 1 and also in cross-section in FIG. 3. When the knee is flexed, the accordeon pleats simply open up, as clearly shown in FIG. 1, for the right legging, and no upward pull is exerted on the gaiter portion 4. The accordeon pleats 15 are integral with the front panel 11 of each legging and are formed by an extra length of material at the knee level of said front panel 11.

The ankle articulation does not cause the same problems as the knee articulation for two reasons:

1° because the amplitude of the ankle rotation barely exceeds 45°, whereas the knee articulation can reach 120°; and 2° because the excentricity of the garment with respect to the articulation axis at the ankle can be reduced to a minimum if the gaiter portion is well applied against the mediotarsus.

The embodiments of the invention in which an exclusive property or privilege is claimed are defined as follows:

1. A rain garment for motorcyclists comprising:

a body-encircling portion, a pair of leggings depending from said body-encircling portion to cover the wearer's entire legs, a gaiter portion at the lower end of each legging to completely cover the wearer's shoes while leaving the undersides of the shoe soles substantially completely exposed, retaining means substantially all around the inner perimeter of the gaiter portion to secure the latter to the perimeter of the sole, said retaining means comprising an elastic strip secured to the inner perimeter of the gaiter portion at the extending below the lower edge thereof, said elastic strip being adapted to be stretched in direct contact with substantially the entire perimeter of the sole and extending all around the perimeter of the sole, pouch means consituting the knee-covering portion of each legging to allow free knee flexing up to 120° without disengagement of the gaiter portion from the wearer's shoes, said pouch means comprising accordeon pleats extending transversely across the front of each legging in the region of the wearer's knee and terminating at the sides of said legging, the back of the bottom portion of each legging, including the gaiter portion and said elastic strip, being longitudinally slit and being provided with a fastener to close said slit, said slit and said fastener extending upwardly toward the back of the knee, and attachment means to secure said garment onto said wearer.

2. A rain garment as claimed in clam 1 wherein each legging has an upper portion formed of a front and back panel secured to each other by longitudinal, lateral lines of stitching and said pouch means are formed by an extension of said front panel which is pleated in accordeon-like fashion at knee level, said pleats extending transversely of the legging from one to the other of said longitudinal lines of stitching.

3. A rain garment as defined in claim 1 wherein said attachment means is an elasticized belt extending around the wearer's waist.

4. A rain garment as claimed in claim 1 wherein each legging has an upper portion formed of a front and a back panel secured to each other by longitudinal, lateral lines of stitching and said pouch means are formed by an extension of said front panel which is pleated in accordeon-like fashion at knee level, said pleats extending transversely of the legging from one to the other of said longitudinal lines of stitching, said front panel extending below said pouch means and enlarged transversely of the legging to constitute one piece of material forming the bottom portion and the gaiter portion of the legging.

5. A rain garment for motorcyclists comprising:

a body-encircling portion, a pair of leggings depending from said body-encircling portion to cover the wearer's entire legs, a gaiter portion at the lower end of each legging to completely cover the wearer's shoes while leaving the undersides of the shoe soles substantially completely exposed, retaining means all around the inner perimeter of the gaiter portion to secure the latter to the perimeter of the sole, said retaining means comprising an elastic strip secured to the inner perimeter of the gaiter portion at and extending below the lower edge thereof, said elastic strip being adapted to be stretched in direct contact with substantially the entire perimeter of the side and extending all around the perimeter of the sole, pouch means constituting the knee-covering portion of each legging to allow free knee flexing up to 120° without disengagement of the gaiter portion from the wearer's shoes, the back of the bottom portion of each legging, including the gaiter portion and said elastic strip, being longitudinally slit and being provided with a fastener to close said slit, said slit and said fastener extending upwardly toward the back of the knee, and attachment means to secure said garment onto said wearer.

* * * * *